US007055695B2

(12) United States Patent
Greenstein et al.

(10) Patent No.: US 7,055,695 B2
(45) **Date of Patent: *Jun. 6, 2006**

(54) CONTAINER PROVIDING A CONTROLLED HYDRATED ENVIRONMENT

(75) Inventors: Michael Greenstein, Los Altos, CA (US); Colin B Kennedy, Greenbrae, CA (US); Huan L Phan, Belmont, CA (US); Stephan Bianchi, Santa Cruz, CA (US); Jonathan R Harris, Menlo Park, CA (US); Daren W Hebold, Raymond, ME (US); Robert A Howard, Palo Alto, CA (US); Andrew L Zee, San Carlos, CA (US)

(73) Assignee: Caliper Life Sciencee, Inc., Mountain View, CA (US)

( * ) Notice: Subject to any disclaimer, the term of this patent is extended or adjusted under 35 U.S.C. 154(b) by 161 days.

This patent is subject to a terminal disclaimer.

(21) Appl. No.: 10/449,517

(22) Filed: Jun. 2, 2003

(65) Prior Publication Data

US 2004/0238401 A1 Dec. 2, 2004

(51) Int. Cl.
*B65D 85/00* (2006.01)

(52) U.S. Cl. ..... 206/723; 206/205; 206/701

(58) Field of Classification Search ..... 206/204, 206/205, 211, 701, 706, 709, 722–724; 220/304, 220/345.6, 787

See application file for complete search history.

(56) References Cited

U.S. PATENT DOCUMENTS

| | | | | | |
|---|---|---|---|---|---|
| 1,434,338 | A | * | 10/1922 | Grose | 206/211 |
| 3,608,771 | A | * | 9/1971 | Monroe et al. | 220/266 |
| 4,815,783 | A | * | 3/1989 | Montreuil et al. | 220/304 |
| 5,169,003 | A | * | 12/1992 | Traupman | 206/524.8 |
| 5,655,706 | A | * | 8/1997 | Vandiver | 220/787 |
| 6,102,198 | A | * | 8/2000 | Merrell | 206/204 |
| 6,646,864 | B1 | * | 11/2003 | Richardson | 206/305 |

FOREIGN PATENT DOCUMENTS

| | | | |
|---|---|---|---|
| DE | 10002666 | A1 | 8/2001 |
| WO | WO-99/61152 | A1 | 12/1999 |
| WO | WO-02/072264 | A1 | 9/2002 |

* cited by examiner

*Primary Examiner*—Luan K. Bui
(74) *Attorney, Agent, or Firm*—Donald R. McKenna; Ann C. Petersen

(57) ABSTRACT

A container is provided for shipping and storing a pre-wetted and pre-conditioned microfluidic "sipper" chip. The container contains both dry compartments and wet compartments. A base contains a fluid-filled reservoir configured to house the capillaries. The opening of the reservoir is sealed with an O-ring. The plastic mount of the chip rests on the base in a dry compartment. The upper surface of the chip contains several wells containing fluid. A gasket is provided with plugs configured to be disposed within and seal the wells. Alternatively, the wells are first sealed with a foil film adhered to the well openings with an adhesive and a gasket is disposed between the foil and a cover, which is removably attached to the base. When the cover is closed, the gasket and O-ring seal the wet compartments to prevent leakage and to slow evaporation.

30 Claims, 9 Drawing Sheets

CONTAINER PROVIDING A CONTROLLED HYDRATED ENVIRONMENT

BACKGROUND OF THE INVENTION

1. Field of the Invention

This invention relates generally to a container, and more particularly to a container that provides a controlled hydrated environment for the shipping and storage of microfluidic devices.

2. Background of the Invention

The use of microfluidic technology has been proposed for use in a number of analytical chemical and biochemical operations. This technology provides advantages of being able to perform chemical and biochemical reactions, macromolecular separations, and the like, that range from the simple to the relatively complex, in easily automatable, high-throughput, low-volume systems. The term, "microfluidic", refers to a system or device having channels and chambers, which are generally fabricated at the micron or submicron scale. In particular, these systems employ networks of integrated microscale channels in which materials are transported, mixed, separated and detected. The working part of the device or chip is made of quartz, fused silica, or glass. The working part is then bonded with a UV-cured adhesive to a plastic mount, such as an acrylic or thermoplastic mount.

One variety of microfluidic devices is called a "sipper" chip. In sipper chips, at least one small glass tube or capillary (the "sipper") is bonded perpendicularly to the substrate of the chip. Typical sipper chips use one to twelve sippers. Once the user prepares the chip and places the chip into a reading instrument, minute quantities of a sample material can be introduced, or "sipped" through the capillary to the chip. This sipping process can be repeated many times enabling a single chip to analyze thousands of samples quickly and without human intervention.

The sipper must be wet prior to use in order to enable the start of flow of sample material into the chip. Because the sipper has a perpendicular orientation with respect to the chip, air bubbles can form easily within the sipper. Such air bubbles can prevent the capillary action of the sipper from drawing the sample material into the channels of the chip. Wetting the sippers correctly (i.e., without forming air bubbles) can be difficult and requires training and skill. Therefore, the sippers are pre-wetted during the final stages of manufacture, so that the formation of air bubbles can be prevented. The sippers must remain wet until use, so the chips are shipped and stored in a hydrated environment.

Additionally, sipper chips are typically shipped after having been preconditioned with sodium hydroxide under pressure. The preconditioning process prepares the surface of the chip for use and increases the lifetime of the chip. The extremely caustic nature of the preconditioning fluid makes it desirable to have the preconditioning performed by technicians prior to shipping as opposed to having the end user apply the sodium hydroxide. The chips are then shipped wet to preserve the preconditioned surface state.

Current shipping and storage methods of wet microfluidic chips typically entail the use of a fluid-filled container. The fluid is generally distilled water containing a preservative such as EDTA or a buffer such as Tris-Tricene. The chip is then submerged in the fluid and suspended in the submerged position. This type of shipping container is undesirable for various reasons. First, the end user must "fish" the chip out of the fluid in which it has been shipped. Secondly, the submersion may weaken the adhesive bonding of the working part of the chip with the plastic mount, resulting in delamination and an unusable chip. Finally, as the chips are capable of being reused many times, the user must replace the chips into the storage fluid between uses, which increases the risk of contaminating the chip.

SUMMARY OF THE INVENTION

Accordingly, the present invention provides a reusable container suitable for shipping and storing microfluidic chips. The container includes a first compartment for housing the mount of the microfluidic chip and a second compartment disposed above or below the first compartment for housing the capillaries of the microfluidic chip. Preferably, the first compartment is dry and the second compartment is hydrated, where the second compartment is sealed to prevent the fluid contained within the second compartment from leaking.

A first embodiment of the container includes a base having an upper surface with a reservoir extending downwardly from an opening therein. A cover is removably attached to the base. A sealing device, such as an O-ring, seals the reservoir to prevent leaking. A flat gasket may be disposed between the cover and the base, with force directors located on one surface thereof to transfer closing force from the cover to the reservoir-sealing device. Additionally, the gasket may have disposed on one surface thereof plugs configured to be sealingly disposed within the wells of the microfluidic chip. The base and/or the cover may be made from a transparent material through which information, such as a chip serial number, may be visually inspected by a user. Also, the base and/or the cover may be made from a material that does not interfere with the transmission of signals, such as radio wave transmissions and optical scanning, so that such signals can be detected and read by machine.

In another embodiment, the container includes a base having an upper surface with a reservoir extending downwardly from an opening therein. A cover is removably attached to the base. A sealing device, such as an O-ring, seals the reservoir to prevent leaking. The wells of the chip are sealed with an adhesive foil prior to closing the cover. Again, the base and/or the cover may be made from a transparent material through which information such as a chip serial number may be visually inspected by the user. Additionally, the base and/or the cover may be made from a material that does not interfere with the transmission of signals, such as radio wave transmissions and optical scanning, so that such signals can be detected and read by machine.

BRIEF DESCRIPTION OF THE DRAWINGS/FIGURES

DETAILED DESCRIPTION OF THE INVENTION

Specific embodiments of the present invention will now be described with reference to the figures, with like numbers indicating identical or functionally similar elements. A person skilled in the relevant art will recognize that other configurations and arrangements can be used without departing from the spirit and scope of the invention.

Figure 1:
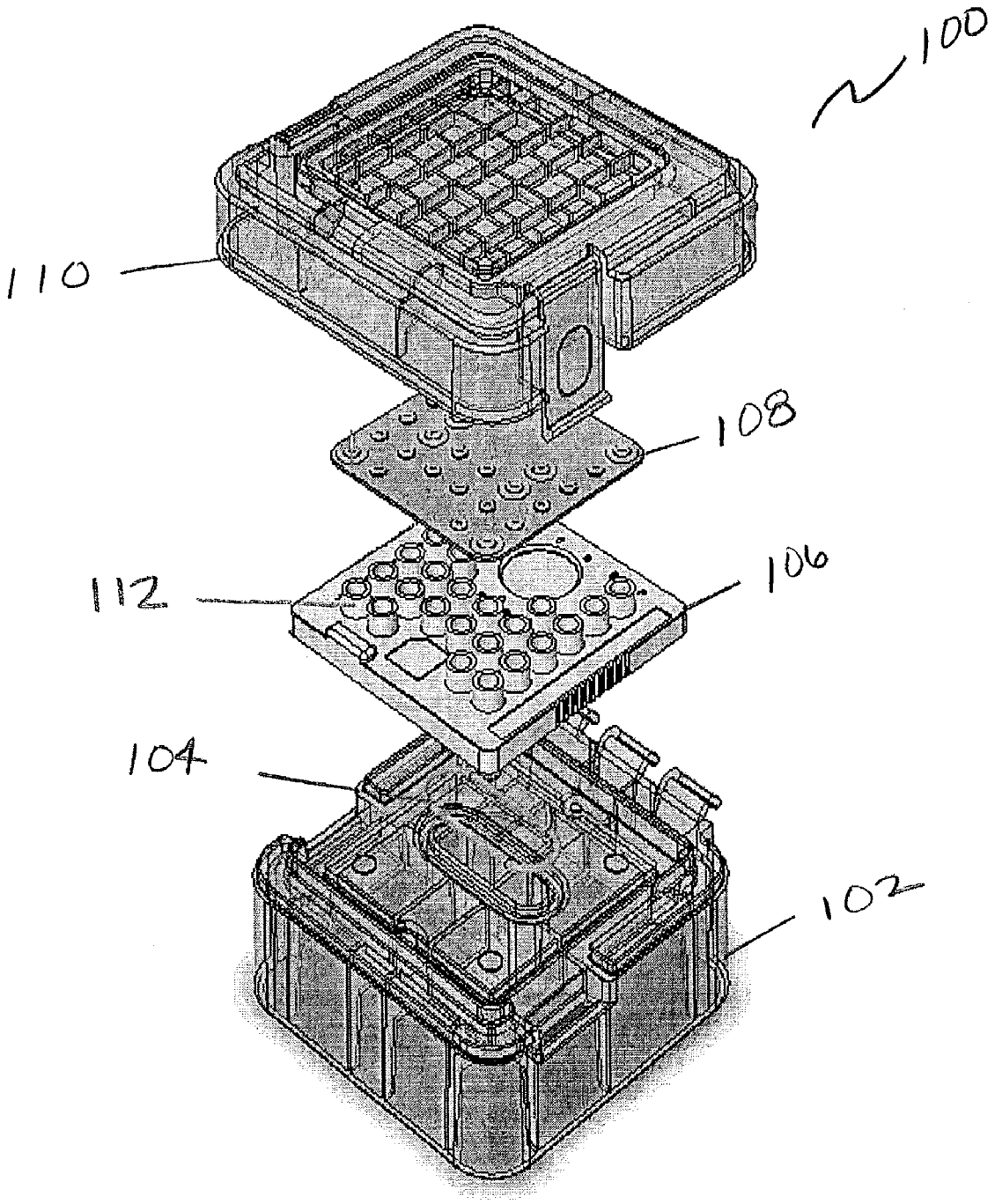
FIG. 1 shows an exploded view of a first embodiment of a container according to the present invention.

Referring now to FIG. 1, a first embodiment of the present invention is shown. Container 100 includes four basic parts: a base 102, an O-ring gasket 104, a cover gasket 108, and a cover 110. For the sake of clarity, microfluidic chip 106 is shown in situ, with at least one sipper located on one side of chip 106 (not shown), and a series of hydrated wells 112 on the other side of chip 106. Although container 100 is shown and intended to be used to house only one chip 106, container 100 may be readily modified to hold greater numbers of chips. For example, cover 110 could be adapted to act as both cover and base so that a series of containers could be linked in a stacked arrangement. Alternatively, base 102 could contain several compartments, each compartment replicating the receptacle and sealing arrangements shown in container 100.

For single-chip storage, the actual size of container 100 depends largely upon the size of chip 106 and the aesthetic preferences of the designer. Representative dimensions of the fully assembled, closed container 100 are 93 mm wide by 102 mm long by 50 mm tall. The walls of base 102 and cover 110 are preferably thin, approximately 2.5 mm, so as to reduce weight and shipping costs.

Figure 2:
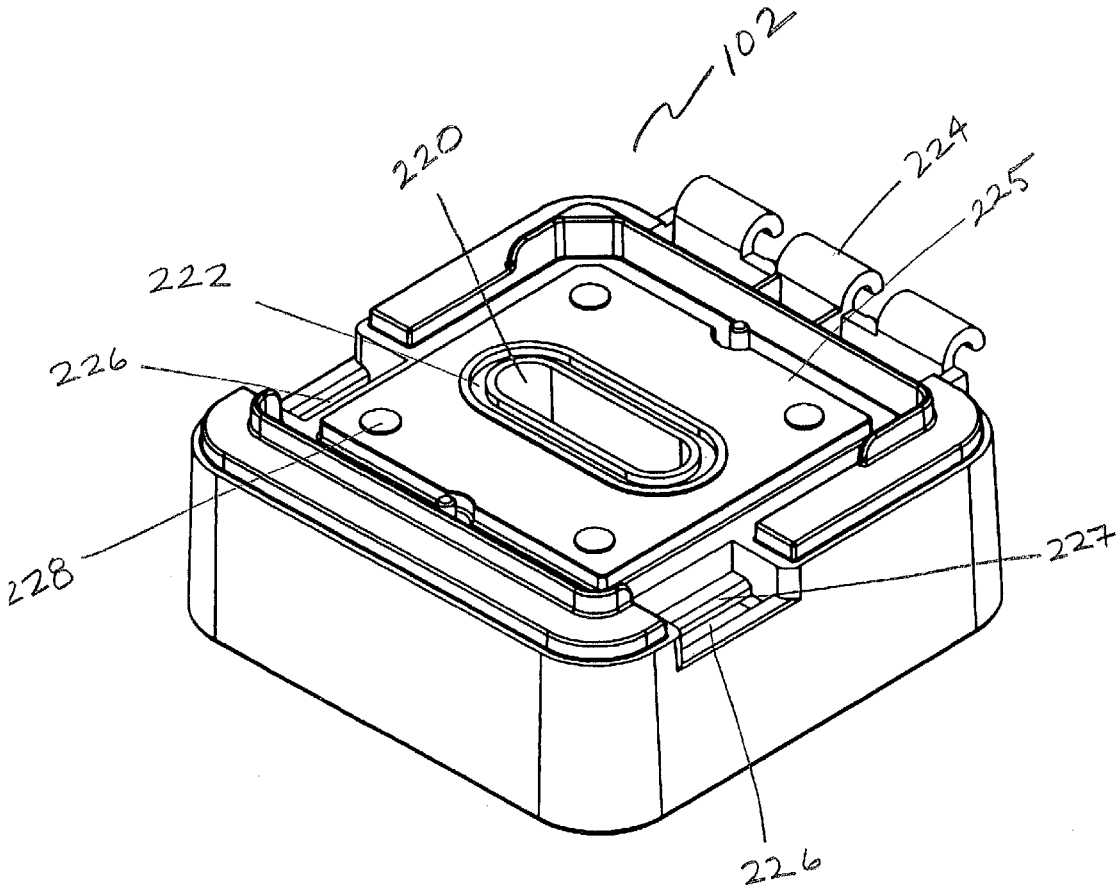
FIG. 2 shows a perspective view of a base of the container in FIG. 1.

Referring now to FIG. 2, base 102 is described in detail. The periphery of base 102 is preferably quadrangular in shape, which conforms generally to the shape of chip 106. However, the shape is not so limited, and may be of any geometric shape, such as circular, triangular, or even irregular.

Base 102 is made from a rigid material, preferably injection-molded plastic. Thermoplastics such as acrylics, polyethylene, and polycarbonate are particularly well suited to the present invention, although composite materials could also be used, such as fiberglass and other epoxy-based materials. A clear material is preferred, so that the contents of container 100 may be easily visually inspected. Additionally, as microfluidic chip 106 may include machine-readable information, such as a scannable bar code or information stored on a microchip, the material preferably does not interfere with the transmission of such information. One example of such a material is clear LEXAN® HF1110, available from GE Plastics in Pittsfield, Mass. and other plastics manufacturers.

Base 102 includes a reservoir 220. Chip 106 has at least one pre-wetted capillary or small tube ("sipper"; not shown) disposed on a lower side thereof. When chip 106 is placed within container 100, chip 106 rests on a raised platform 225, which forms part of an upper surface of base 102. Reservoir 220, the opening of which is disposed in raised platform 225, accommodates the sipper. Additionally, fluid is preferably disposed within reservoir 220 to maintain the wetted condition of the sipper in all container orientations. The fluid is preferably distilled water containing a preservative such as EDTA, although other fluids, including but not limited to Tris-Tricine buffer or plain distilled water, are also contemplated. Alternatively, reservoir 220 may remain dry, containing, for example, air, nitrogen, or inert gases.

In order to prevent leakage of the fluid contained within reservoir 220, the opening must be sealed against the lower surface of the mount of chip 106. Preferably, the seal is achieved using a sealing means such as an O-ring 104 (shown in FIG. 1) seated within a shallow groove 222 surrounding the opening of reservoir 220. O-ring 104 preferably has an oval or circular cross-sectional geometry and conforms to the shape of shallow groove 222. Alternatively, O-ring 104 could have a square or rectangular cross-sectional geometry. O-ring 104 is made of any soft, flexible material that is chemically inert to the fluid contained within reservoir 220, preferably silicone, although other materials, including but not limited to neoprene, rubber, polyurethane, and thermoplastic elastomers are also appropriate. When container 100 is closed, O-ring 104 deforms to provide a fluid-tight seal against the bottom of chip 106 to prevent leakage of the fluid contained within reservoir 220.

Alternatively, a flat gasket may be used as a sealing means to seal reservoir 220. The gasket has a shape generally mirroring that of the surface of raised platform 225. A hole is disposed in the gasket to allow the sippers to pass therethrough. The gasket is made of the same material as O-ring 104. As with O-ring 104, when container 100 is closed, the gasket deforms to provide a fluid-tight seal against the bottom of chip 106. Yet another option for sealing reservoir 220 is to adhere chip 106 to the surface of raised platform with fluid-impermeable adhesive tape.

Reservoir 220 may be dry, i.e., reservoir 220 provides a location for housing the sippers, but does not supply additional hydration. In this case, each individual sipper could be sealed, as with duckbill valves or caps. These valves or caps could be disposed on the ends of the sippers, or the valves or caps may be attached to the lower surface of reservoir 220 and the ends of the sippers would be inserted into the valves or caps when chip 106 is inserted into container 100. Alternatively, a compliant material may line the bottom of reservoir 220, and the material would seal the ends of the sippers when the sippers are pushed against the material.

Another feature of base 102 is a plurality of pylons 228 disposed at the corners of raised platform 225. Pylons 228 are small cylindrical protrusions extending slightly upward from raised platform 225. The height of pylons 228 is such that pylons 228 do not interfere with the creation of the seal between gasket 104 and chip 106. Pylons 228 serve to stabilize chip 106 during closure of container 100 by preventing chip 106 from rocking. Four pylons 228 are shown in the current embodiment, one in each corner of base 102. However, the number of pylons 228 may vary as long as the distribution of pylons 228 on the surface of platform 225 is sufficiently even so as to prevent rocking. Such a variation in the number of pylons is particularly warranted if the shape of base 102 is not quadrangular.

Figure 3:
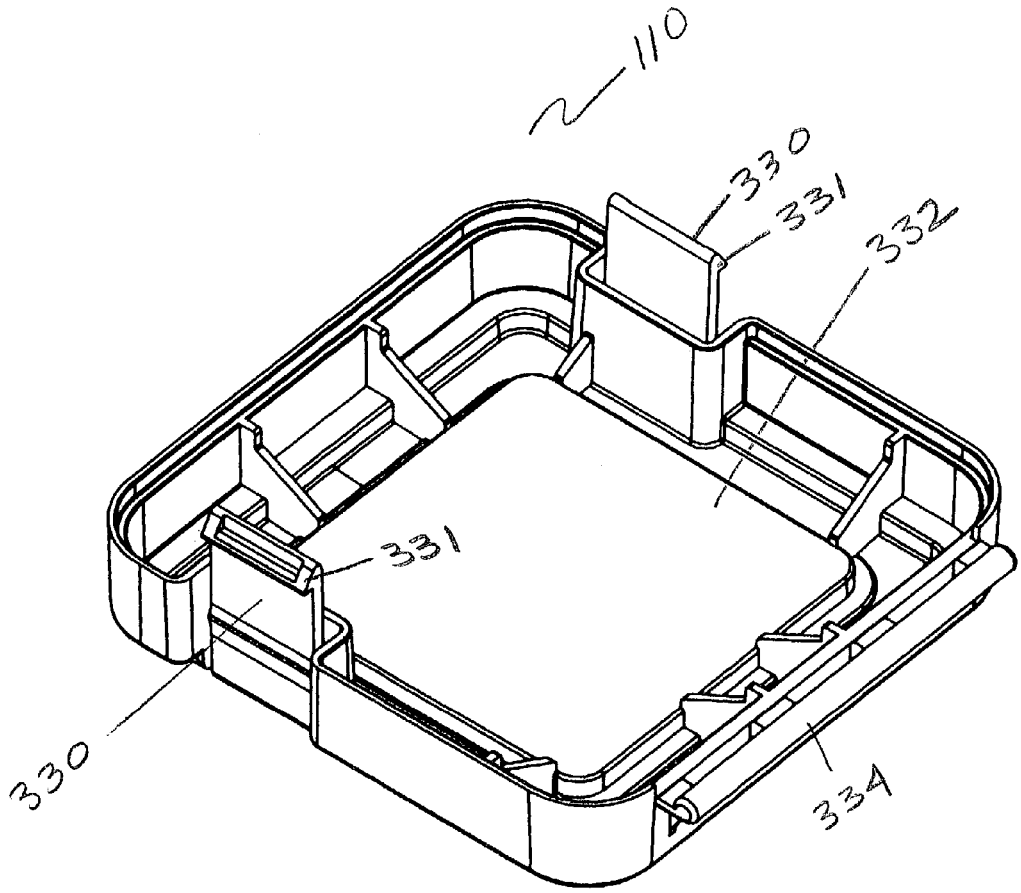
FIG. 3 shows a perspective view of the inside of a cover of the container in FIG. 1.

Cover 110, shown in greater detail in FIG. 3, has a periphery shape complementary to that of base 102, again, preferably a generally quadrangular shape. As with base 102, cover 110 is preferably made of a thermoplastic material, but also composites. The material used for cover 110 is preferably the same as that used for base 102, although the materials could be different. Again, as chip 106 is likely to include a label, cover 110 is preferably made of a clear material so that the label can be visually inspected without having to remove cover 110 from base 102. Also, as chip 106 may contain optical, electronic, or digital machine-readable information, such as a scannable bar code or information stored on a microchip, as with base 102, cover 110 is preferably made of a material that does not interfere with the transmission of machine-readable information.

Referring now to FIGS. 2 and 3, the secure attachment of base 102 to cover 110 is now described. On one side of base 102 is disposed a series of inverted U-shaped structures 224, which form one half of the hinge for connecting base 102 to cover 110. As can be seen in FIG. 3, a bar 334 on one side of cover 110 is configured to be disposed within U-shaped structure 224. Bar 334 can then rotate within structure 224 to create a hinged attachment between cover 110 and base 102. The hinged attachment allows container 100 to be opened and closed multiple times. U-shaped structures 224 and bar 334 are preferably integrally co-molded with base 102 and cover 110, respectively, although other connecting devices, such as a separate hinging device, may alternatively be included. Alternatively, cover 110 may be entirely separable from base 102, with no hinge or other connecting portion.

Also, as seen in FIG. 2, base 102 contains two openings 226 disposed opposite one another on the sides of base 102 adjacent to the side on which structure 224 is disposed. Openings 226 include stays 227 formed therein. Openings 226 are receptacles for press-fit flanges 330 disposed on cover 110 on either side of flat surface 332, as shown in FIG. 3. Disposed at the lower end of flanges 330 are small protrusions 331. As flanges 330 are pushed into openings 226, protrusions 331 are forced past stays 227. Once inserted into openings 226, stays 227 prevent the release thereof by providing retaining force against protrusions 331. In order to open container 100, flanges 330 must be simultaneously squeezed while being removed from openings 226 so that protrusions 331 may clear stays 227. This operation may be repeated for multiple openings and closures of container 100. Although press-fit flanges and receptacles are shown to secure cover 110 to base 102, other types of conventional closures may also be used, such as latches and snap closures, as would be apparent to one skilled in the art.

Figure 4:
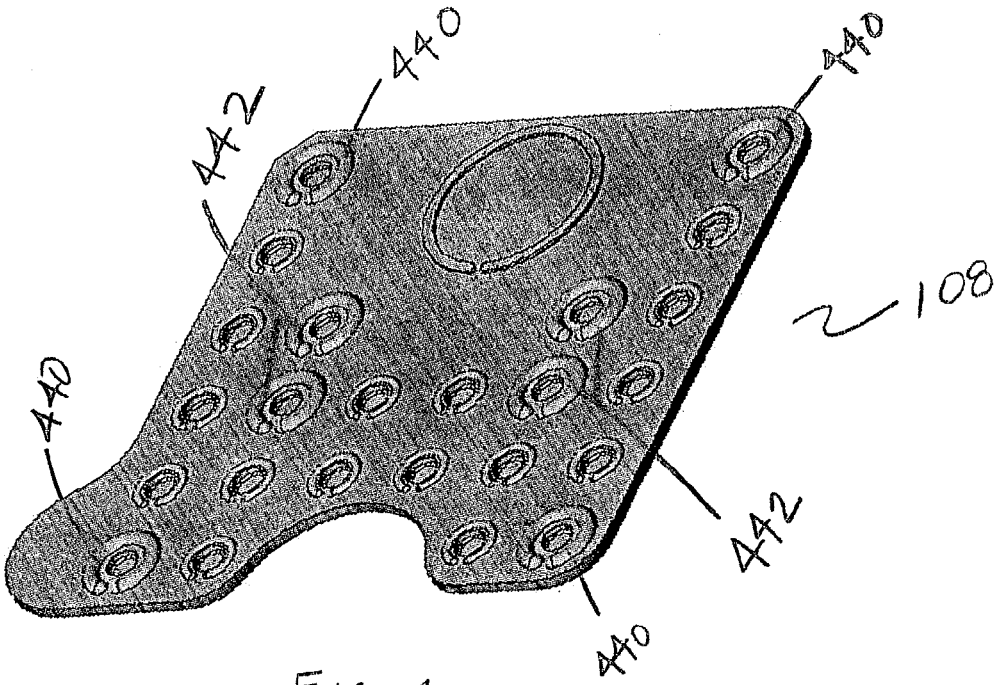
FIG. 4 shows a first side of a gasket of the container in FIG. 1.
Figure 5:
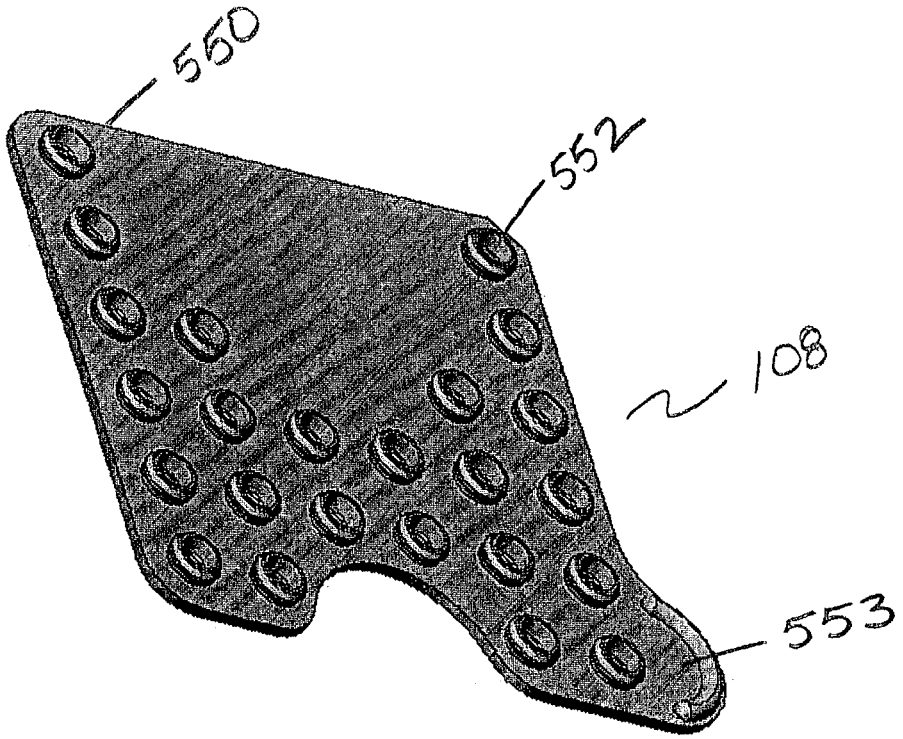
FIG. 5 shows the reverse side of the gasket of FIG. 4.

Referring now to FIGS. 4 and 5, gasket 108 is used to seal wells 112 on chip 106 during storage of chip 106. Wells 112 contain fluid similar to that found in reservoir 220. Similar to O-ring 104, gasket 108 is made from a soft, fluid-impermeable material that can deform so as to seal between cover 110 and chip 106 effectively. Examples of appropriate materials include but are not limited to rubber, silicone, neoprene, polyurethane, and other thermoplastic elastomers.

In this embodiment, force directors 440, 442 on one surface of gasket 108 provide a force transfer mechanism between cover 110 and portions of base 102. Force directors 440, 442 are generally toroidal protrusions extending upwards from the surface of gasket 108. Force directors 440, 442 are preferably co-formed with the rest of gasket 108. Force directors 440 are disposed on one surface of gasket 108 so as to correspond to the corners of chip 106. Force directors 440 transfer closing force evenly to chip 106, thereby preventing an uneven transfer of closing force from causing the chip to rock, and be potentially damaged, during closure.

Force directors 442 are located within the periphery of gasket 108 and transfer closing force to O-ring 104. Thus, less force is required to close the container while still ensuring that a tight seal is formed at the opening of reservoir 220. Without protrusions such as force directors 442, much greater force would be required to create a seal, and the seal may not be made evenly, which could result in leaks.

Figure 6:
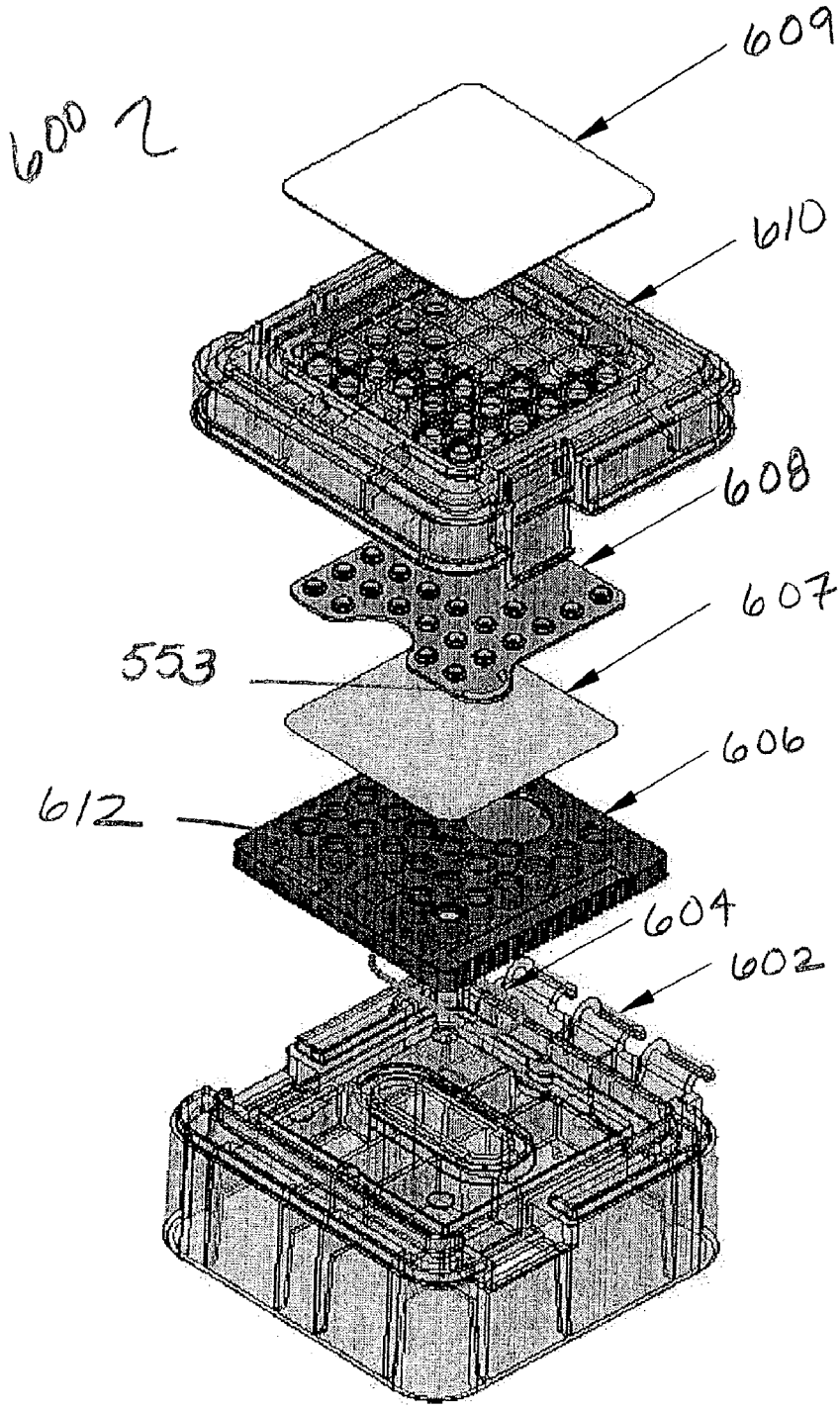
FIG. 6 shows an exploded view of a second embodiment of a container according to the present invention.

Disposed on the other side of gasket 108 are a plurality of plugs 550, as shown in FIG. 5. These plugs are arranged in a pattern on gasket 108 so as to correspond to the pattern of wells 112 on chip 106. The number of plugs 550 depends upon the number of wells 112 on chip 106; at least one plug 550 is provided for each well 112. The number of plugs 550 may be greater than the number of wells 112 on an individual chip 106, as container 100 may be designed for a family of chips 106 with varying numbers of wells 112. A typical number of wells 112 on a chip 106 ranges from eight (8) to thirty-two (32), although this number can vary widely depending upon the intended use of chip 106. The embodiments shown in FIGS. 1 and 6 are configured for a chip with twenty-four (24) wells.

Plugs 550 are cylindrical protrusions from the surface of gasket 108. Plugs 550 are preferably solid. A solid configuration has the advantage over a hollow design in that the distance for water permeation through plugs 550 is greatly increased. Alternately, however, a central bore 552 may create a hollow interior to the cylinder of plug 550.

Gasket 108 is preferably removable from container 100. When the user initially opens cover 110, gasket 108 is positioned so that plugs 550 are disposed within and are sealing wells 112 of chip 106. Plugs 550 must be removed from wells 112 by user in order to use chip 106; this removal may be achieved by manually pulling gasket 108 away from chip 106 in a peeling motion. As chip 106 may be reused, gasket 108 must be replaced prior to storage so that wells 112 may be properly sealed for evaporation control. For this reason, gasket 108 may optionally include a shape key 553. When included, shape key 553 is preferably a projection extending outward from one corner of gasket 108. This projection prevents proper closure of cover 110 unless gasket 108 is inserted into container 100 in the proper orientation, as cover 110 includes complementary geometry on the interior thereof.

Figure 5A:
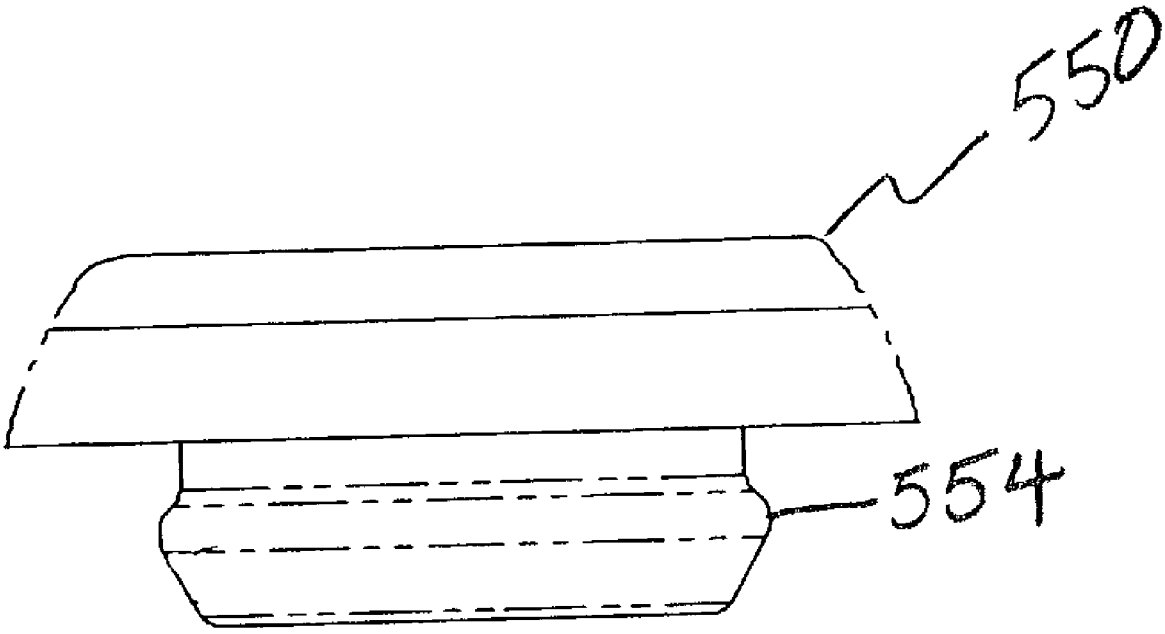
FIG. 5A shows an enlarged side view of a plug from the surface of the gasket shown in FIG. 5.

As shown in FIG. 5A, a projection 554 is disposed at or near the free end of plug 550. Projection 554 acts as an O-ring, and deforms within well 112 to create a tight seal to limit evaporation.

Alternatively, gasket 108 may also simply be a flat piece of fluid-impermeable, deformable material (not shown), shaped so as to fit snugly between the top of chip 106 and the flat surface 332 of cover 110. In such an embodiment, gasket 108 would simply seal across the tops of wells due to the inherent deformability of the material. A flat gasket 108 requires the delivery of additional sealing force by cover 110 as compared to the seal created by plugs 550.

Referring now to FIG. 6, an exploded view of an alternate embodiment of the present invention is shown. As with the embodiment shown in FIG. 1, container 600 includes a base 602, an O-ring 604, a gasket 608, and a cover 610. Microfluidic chip 606 is again shown in situ for the sake of clarity. These components of container 600 are substantially the same as the corresponding components described above with respect to container 100, including all variations of material and style. Container 600, however, further includes a sealing film 607 and a top label 609.

Sealing film 607 is a very thin foil of moisture-proof material with an adhesive applied to one side. Preferably, the adhesive is paper-backed until application to chip 606. The material of the foil should be vapor-tight, such as a metal foil, a plastic foil, or a composite foil using both metal and plastic. The material for sealing film is preferably aluminum, although many materials known in the art could also be appropriate.

The adhesive used for sealing film 607 must be chemically inert to the buffer solution placed in wells 612 so that the hydration of the wells and the chemical purity thereof are not compromised. The adhesive side of sealing film 607 is then adhered to the top surfaces of wells 612, preferably by pressing the foil thereto, thereby creating a vapor-tight seal of wells 612. Alternatively, the adhesive may be a thin layer of thermoset material. In this case, sealing foil 607 is placed over wells 612 and then heat and pressure treated. This treatment causes the adhesive to set, although caution must be taken not to compromise the top surface of the plastic chip mount.

Figure 7:
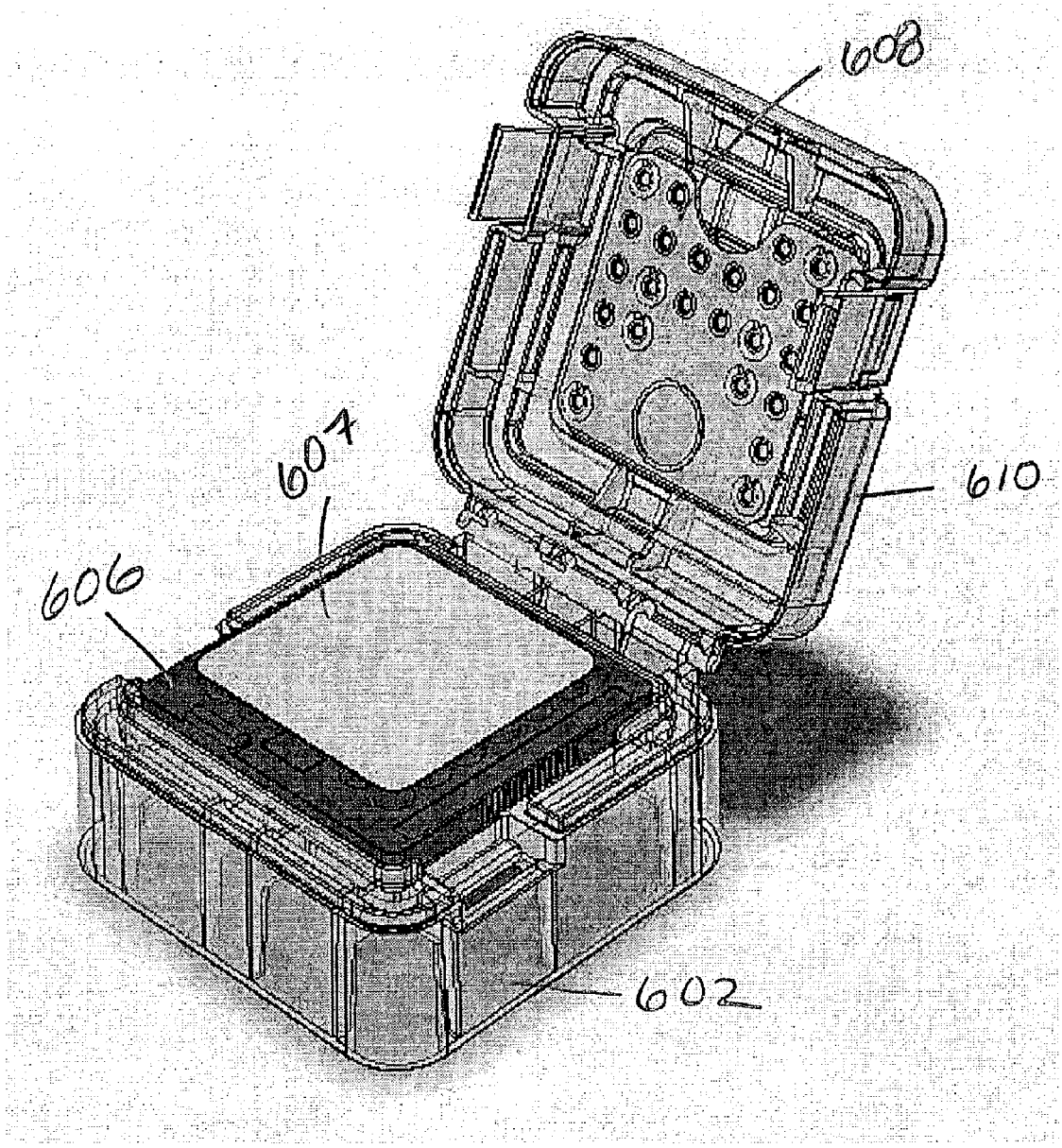
FIG. 7 shows the container of FIG. 6 after the initial opening thereof by an end user.
Figure 8:
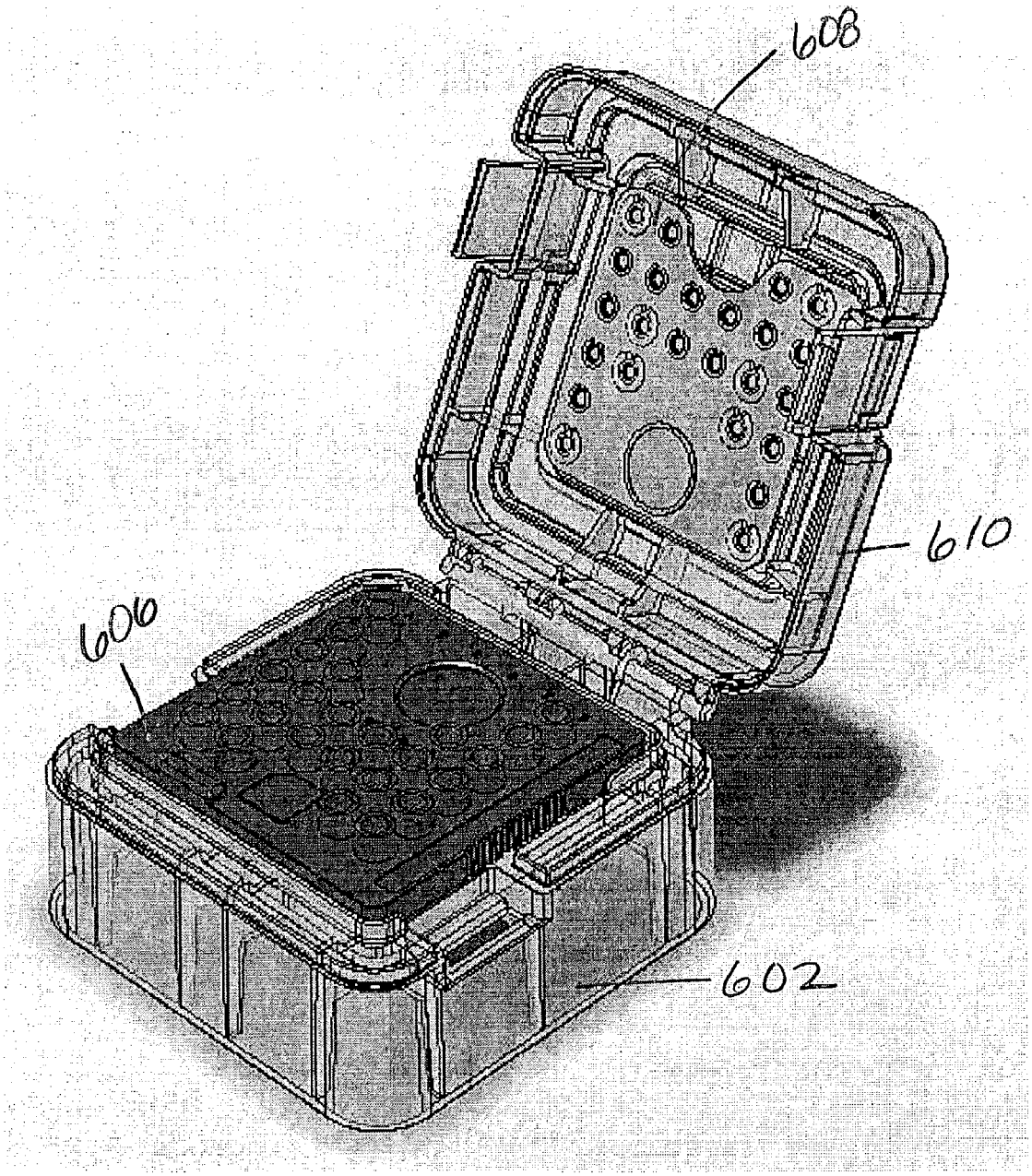
FIG. 8 shows the container of FIG. 6 after a foil seal has been removed.

As shown in FIG. 7, sealing film 607 is adhered to the top surfaces of wells 612 of chip 606 with the foil side facing cover 610. This extra layer of sealing is intended to provide an extremely secure seal during the shipping stage, prior to the first use by the customer. Although a reusable sealing film 607 may be used in container 600, sealing film 607 is preferably not reusable within container 600 after first use. Sealing film 607 is preferably peeled off of chip 606 by the user and discarded, as is shown in FIG. 8.

Figure 9A:
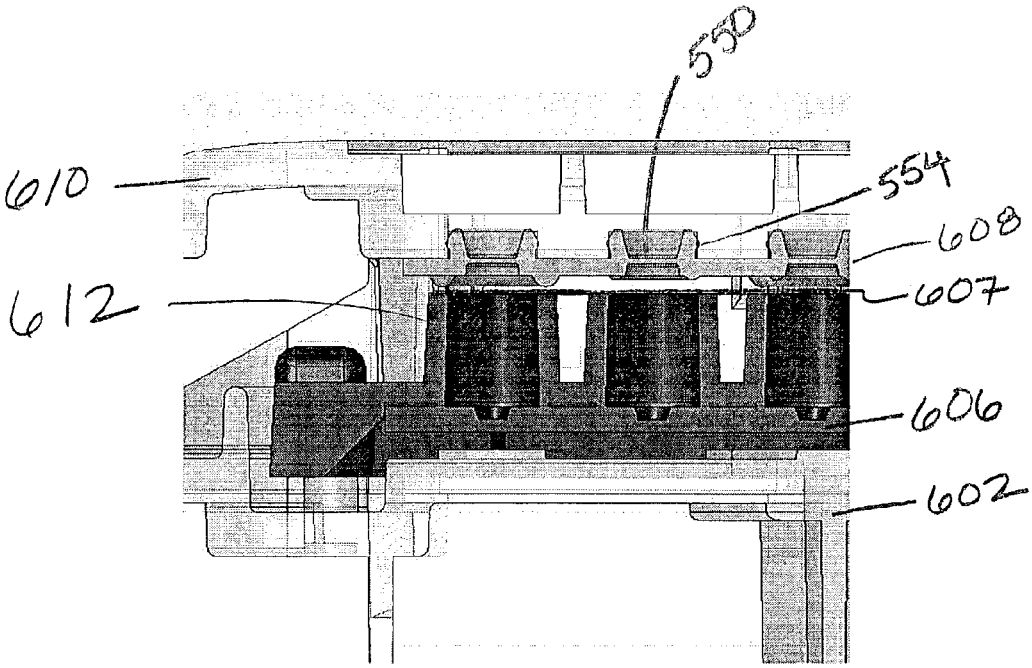
FIG. 9A shows a sectional view of a portion of the container of FIG. 6 with the gasket in an inverted shipping position.
Figure 9B:
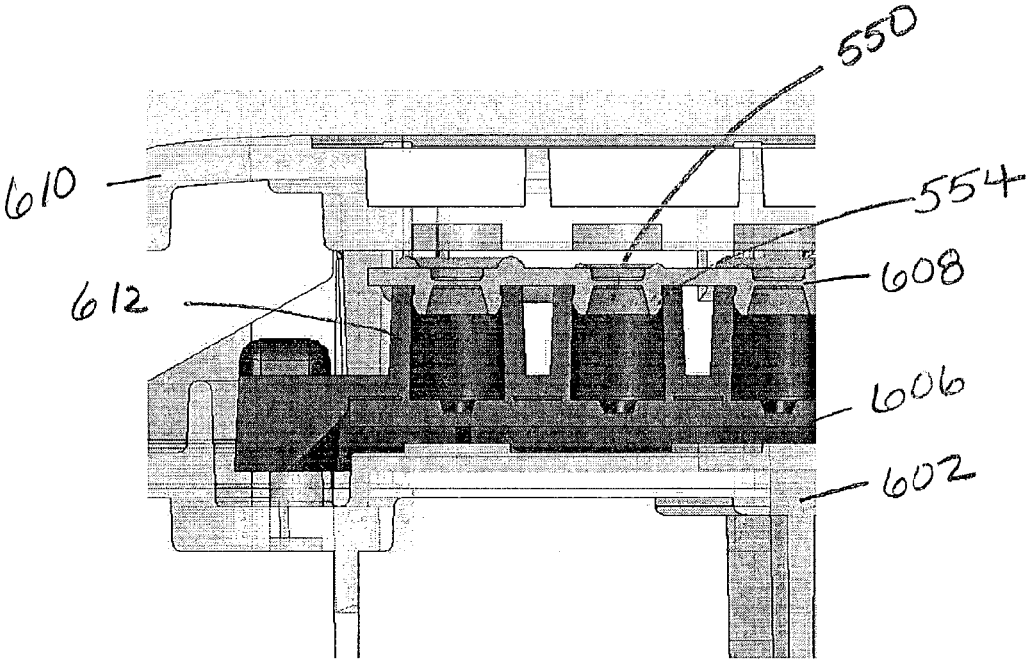
FIG. 9B shows a sectional view of a portion of the container of FIG. 6 with the gasket in a storage position.

Referring now to FIGS. 9A and 9B, the orientation of gasket 608 within container 600 will be described. When sealing film 607 is sealing wells 612, plugs 550 of gasket 608 are not needed to seal wells 612. Indeed, if gasket 608 is oriented within container 600 so that plugs 550 are facing chip 606, plugs 550 would interfere with the closing of container 600, as sealing film 607 would block the entry of plugs 550 into wells 612. Therefore, during shipping, when sealing film 607 is adhered to chip 606, gasket 608 is oriented within cover 610 so that plugs 550 face away from chip 606. This orientation is shown in FIG. 9A.

However, once sealing film 607 is removed, plugs 550 are required to seal wells 612 during storage of chip 606. The duration of storage is anticipated to be approximately six (6) months. The user of chip 606 inverts gasket 608 so that plugs 550 now face chip 606, as is shown in FIG. 9B. Upon re-closure of container 600, plugs 550 are inserted into wells 612 of chip 606, and projections 554 seal wells 612. For this embodiment, gasket 608 preferably includes shape key 553, as described above with respect to the first embodiment, so as to act as a placement guide for the user, i.e., gasket 608 will only fit into container 600 in the appropriate orientation. This shape-guide aspect of gasket 608 can be seen best in FIG. 6.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A container for shipping and storing a microfluidic chip comprising:

a base having an upper surface with a reservoir formed therein, wherein the reservoir extends downwardly from an opening in the upper surface of the base;

sealing means for sealing the reservoir;

a cover removably attached to the base;

a conformable gasket disposed between the cover and the base, the conformable gasket including a plug disposed on a surface of the gasket, the plug configured to be sealingly disposed within a well of a microfluidic chip, the conformable gasket further including a force director disposed on a surface of the gasket, wherein a downward closing force applied to the cover is transferred to the sealing means through the force director.

2. The container according to claim 1, wherein the sealing means is a deformable O-ring.

3. The container according to claim 2, wherein said O-ring is made of rubber, silicone, neoprene, polyurethane, or other thermoplastic elastomer.

4. The container according to claim 1, wherein the gasket is shaped so as to guide placement thereof within the cover.

5. The container according to claim 1, wherein the gasket is made of rubber, silicone, neoprene, polyurethane, or other thermoplastic elastomer.

6. The container according to claim 1, wherein the reservoir contains fluid.

7. The container according to claim 6, wherein said fluid is distilled water, distilled water containing a preservative, or a buffering solution.

8. The container according to claim 1, wherein the reservoir contains air, nitrogen gas, or an inert gas.

9. The container according to claim 1, wherein said cover is made from a plastic material.

10. The container according to claim 1, wherein at least a portion of said cover is made from a transparent or translucent material.

11. The container according to claim 1, wherein at least a portion of said cover is made from a material that does not interfere with the transmission of machine-readable data.

12. The container according to claim 1, wherein said base is made from a plastic material.

13. The container according to claim 1, wherein at least a portion of said base is made from a transparent or translucent material.

14. The container according to claim 1, wherein at least a portion of said base is made from a material that does not interfere with the transmission of machine-readable data.

15. The container according to claim 1, wherein a label is disposed on an upper surface of said cover.

16. The container according to claim 1 wherein a plurality of pylons is disposed on said upper surface of said base.

17. A system for shipping and storing comprising:

a microfluidic chip having at least one well disposed on a surface thereof; and a container including a base having an upper surface with a reservoir formed therein, wherein the reservoir extends downwardly from an opening in the upper surface of the base, sealing means for sealing the reservoir, and a cover removably attached to the base, wherein said microfluidic chip is disposed within said container.

18. The system according to claim 17, wherein the sealing means is an O-ring that deforms to provide a fluid-tight seal against the bottom of the microfluidic chip.

19. The system according to claim 17, further including a deformable gasket disposed between the cover and the base.

20. The system according to claim 19, wherein at least one force director is disposed on at least one surface of said gasket, wherein a downward closing force applied to said cover is transferred to said sealing means through said force director.

21. The system according to claim 19, wherein at least one plug is disposed on at least one surface of said gasket, said plug configured to be sealingly disposed within said well.

22. The system according to claim 19, wherein said gasket is shaped so as to guide placement thereof within said cover.

23. The system according to claim 19, wherein a sealing film seals said at least one well.

24. The system according to claim 19, wherein the reservoir contains a fluid.

25. The system according to claim 17, wherein said cover is made from a plastic material.

26. The system according to claim 17, wherein at least a portion of said cover is made from a transparent or translucent material.

27. The system according to claim 17, wherein said base is made from a plastic material.

28. The system according to claim 17, wherein at least a portion of said base is made from a transparent or translucent material.

29. The system according to claim 17, wherein a label is disposed on an upper surface of said cover.

30. The system according to claim 17, wherein said microfluidic chip includes machine-readable information, and at least a portion of said container is made from a material that does not interfere with the transmission of the machine-readable information.

* * * * *